US005927261A

United States Patent [19]

Bofill

[11] Patent Number: 5,927,261

[45] Date of Patent: Jul. 27, 1999

[54] ADJUSTABLE GAS CARTRIDGE MOUNT

[76] Inventor: Peter Bofill, 491 E. 55th St., Hialeah, Fla. 33013

[21] Appl. No.: 08/867,947

[22] Filed: Jun. 3, 1997

[51] Int. Cl.[6] ..... F41B 11/06

[52] U.S. Cl. ..... 124/80; 124/56; 124/74

[58] Field of Search ..... 124/56, 71, 73, 124/74, 80

[56] References Cited

U.S. PATENT DOCUMENTS

| | | | |
|---|---|---|---|
| 3,735,747 | 5/1973 | Barjavel | 124/74 |
| 5,086,749 | 2/1992 | Ekstrom | 124/74 |
| 5,280,778 | 1/1994 | Kotsiopoulos | 124/73 |
| 5,383,442 | 1/1995 | Tippmann | 124/73 X |
| 5,462,042 | 10/1995 | Greenwell | 124/56 X |
| 5,613,483 | 3/1997 | Lukas et al. | 124/73 |

*Primary Examiner*—John A. Ricci
*Attorney, Agent, or Firm*—Malloy & Malloy, P.A.

[57] ABSTRACT

The present invention is directed towards an adjustable gas cartridge mount to be used on a paint gun that utilizes a gas cartridge to propel paint pellets from the paint gun. The adjustable gas cartridge mount includes a primary bracket which is structured to be secured to the paint gun and a cartridge engagement assembly which holds the gas cartridge in an effective orientation. Specifically, the cartridge engagement assembly includes an extension segment, which is slidingly coupled to the primary bracket and extends vertically downwards from the paint gun, and a cartridge coupling bracket structured to be coupled to both the gas cartridge and to the extension segment. The mount is structured such that the position of the extension segment may be moved in a forwards or backwards manner within the primary bracket in order to facilitate an enhanced balance between the gas cartridge and the paint gun. The cartridge coupling bracket is structured to secure the gas cartridge in a generally horizontal orientation relative to the paint gun, thereby ensuring that the gas cartridge does not interfere with a user's grasping and manipulating of the paint gun. Moreover, the cartridge coupling bracket is structured to be secured either in a variety of orientations relative to the extension segment so as to achieve a desired, optimal alignment of the gas cartridge relative to a central axis of the paint gun.

20 Claims, 3 Drawing Sheets

ADJUSTABLE GAS CARTRIDGE MOUNT

BACKGROUND OF THE INVENTION

1. Field of the Invention

The present invention relates to an adjustable gas cartridge mount to be used on a paint gun of the type which utilizes a gas cartridge to propel paint pellets from the paint gun. In particular, the adjustable gas cartridge mount is oriented towards retaining a gas cartridge in a substantially comfortable, adjustable and convenient position relative to the paint gun barrel so as to provide better maneuverability and control of the loaded paint gun to a user.

2. Description of the Related Art

There are a wide variety of paint guns which utilize a compressed gas cartridge to propel paint pellets or other projectiles. Most commonly, the compressed gas cartridge consists of an elongate generally tubular canister filled with a highly compressed gas such as Nitrogen. Additionally, the compressed gas cartridge is usually constructed of a rigid, generally heavy, metallic construction. Moreover, the compressed gas cartridge is necessarily removably secured to the paint gun, in fluid-flow communication therewith, so that highly compressed gas can be utilized to propel projectiles upon actuation of a trigger mechanism and so that once the gas within a particular cartridge becomes exhausted a new cartridge can be secured.

Although such compressed gas paint guns are generally effective in the manner in which they propel the paint balls, they are seen as being unavoidably very cumbersome and awkward to handle. Furthermore, due to the weight of a filled cartridge and the configuration of known paint ball guns, the compressed gas cartridge is mounted in a generally vertical manner so that it is perpendicular to the main axis of the paint gun. Unfortunately, however, the bulk and size of the compressed gas cartridge disposed in a vertical manner perpendicular to the main axis of the paint gun makes carrying the paint gun for a substantial length of time very burdensome and irritating, and perhaps more importantly makes the paint gun very difficult to control and maneuver quickly.

In particular, it is common for such paint guns to be utilized in various sporting games wherein members of different teams attempt to shoot at members of opposing teams with a paint pellet. During such games, maneuverability of the players is a paramount concern, and to be successful, a team member must be very adept at crawling, kneeling, or otherwise sneaking up within shooting distance of an opposing team's player. Since such competition is typically held in dense woods, it is imperative that the paint gun is not impeded by thick brush, vegetation, or other tight quarters. The smaller the total area/profile that the paint gun occupies, the more maneuverable and easy it will be to control. Unfortunately, however, the vertical orientation of the gas cartridge in perpendicular relation to the main axis of the paint gun makes it very difficult to quickly maneuver the paint gun and takes up a tremendous amount of vertical space. Additionally, there is a much greater likelihood that the vertically oriented gas cartridge will become entangled in vegetation or other obstacles. Accordingly, due to the larger profile and generally awkward, unbalanced nature of the paint gun and gas cartridge, there is a significant reduction in a user's reaction time due to the extra force required to quickly turn the paint gun. This is due to the additional leverage required because the center of mass of the paint gun is disposed a significant distance below the handle of the paint gun.

In the past, those skilled in the art have attempted to alleviate the problems associated with the maneuverability of paint guns equipped with a gas cartridge by utilizing smaller sized gas cartridges. Although this helps reduce the bulkiness and weight of the paint guns, it does not significantly improve the maneuverability Furthermore, utilizing smaller gas cartridges requires that a user frequently refill the gas cartridge with a new supply of compressed gas. Naturally, stopping to refill the gas cartridge is an inconvenient and time-consuming procedure that detracts from the enjoyment of the game.

Accordingly, there is still a need in the art for a gas cartridge mount which permits a gas cartridge to be secured onto a paint gun in a more convenient and low profile orientation relative to the main axis of the paint gun so as to substantially increase the maneuverability and handling of the paint gun while increasing a user's control and reducing user reaction time. More particularly, there is a need in the art for an adjustable gas cartridge mount which is adaptable so that the gas cartridge can be effectively positioned with existing paint gun designs and in a variety of desirable orientations for right handed or left handed users and at a personal, desired longitudinal direction relative to the paint gun.

SUMMARY OF INVENTION

The present invention is directed towards an adjustable gas cartridge mount to be used on a paint gun. In particular, the adjustable gas cartridge mount is to be used on the type of paint gun which utilizes a gas cartridge to propel paint pellets from the paint gun and is structured to removably mount the gas cartridge to the paint gun.

Specifically, the adjustable gas cartridge mount includes a primary bracket which is generally elongate and is structured to be secured to the paint gun. Additionally, the adjustable gas cartridge mount includes a cartridge engagement assembly. The cartridge engagement assembly further includes an extension segment. The extension segment is coupled to the primary bracket and extends vertically downwards from the paint gun so as to provide some spacing from the paint gun itself.

The cartridge engagement assembly further includes a cartridge coupling bracket. The cartridge coupling bracket is structured to be coupled to both the gas cartridge and the extension segment. Moreover, the cartridge coupling bracket is structured to secure the gas cartridge in a generally horizontal orientation relative to the paint gun, thereby substantially helping to insure that the gas cartridge does not interfere with a user's grasping and manipulating the paint gun. In particular, the weight of the gas cartridge is positioned in greater alignment with the center of gravity of the paint gun, and a reduced, more maneuverable profile is achieved.

It is an object of the present invention to provide an adjustable gas cartridge mount which maintains a gas cartridge in a substantially horizontal orientation generally parallel to the main axis of the paint gun.

A further object of the present invention is to provide an adjustable gas cartridge mount which is adaptable so that the gas cartridge can be maintained either to the left side of the paint gun, to the right side of the paint gun, or directly underneath the paint gun.

Another object of the present invention is to provide an adjustable gas cartridge mount which maintains a gas cartridge so that it does not interfere with a user's grasping and manipulating of the paint gun.

An additional object of the present invention is to provide an adjustable gas cartridge mount which is structured to permit the lateral movement of the gas cartridge relative to the paint gun in a forward or backward position.

It is a further object of the present invention to provide an adjustable gas cartridge mount which substantially increases a user's control and maneuverability of the paint gun and reduces a user's reaction time in operating the paint gun.

Also an object of the present invention is to provide an adjustable gas cartridge mount that can be effectively utilized with a variety of existing paint ball guns in order to precisely position a gas cartridge an a specific, desired orientation.

These and other objects, features, and advantages of the present invention will become more readily apparent from the attached drawings and the detailed description of the preferred embodiments, which follows:

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings

DETAILED DESCRIPTION OF THE PREFERRED EMBODIMENT

Shown throughout the figures, the present invention is directed towards an adjustable gas cartridge mount, generally indicated as 10. The adjustable gas cartridge mount 10 is oriented for use on a paint ball gun. More specifically, the adjustable gas cartridge mount 10 is to be used on a type of paint ball gun which utilizes a gas cartridge 60 to propel paint pellets/balls from the paint gun. The adjustable gas cartridge mount 10 is structured to removably mount the gas cartridge 60 to the paint gun so as to facilitate its use and interchanging when necessary.

Figure 1:
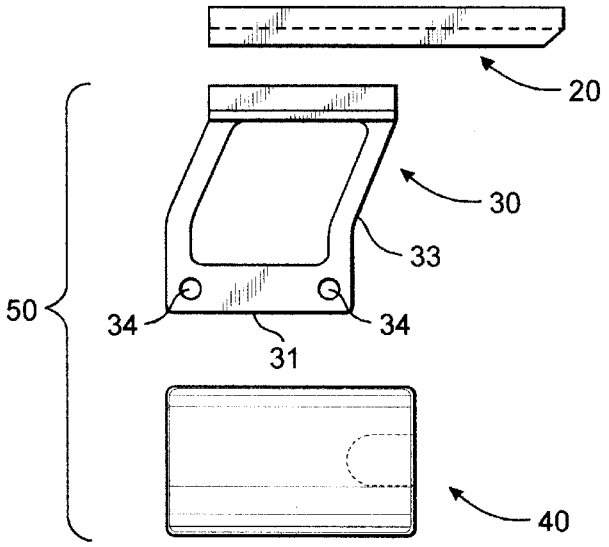
FIG. 1 is a side view of the adjustable gas cartridge mount in it's dis-assembled orientation.
Figure 7:
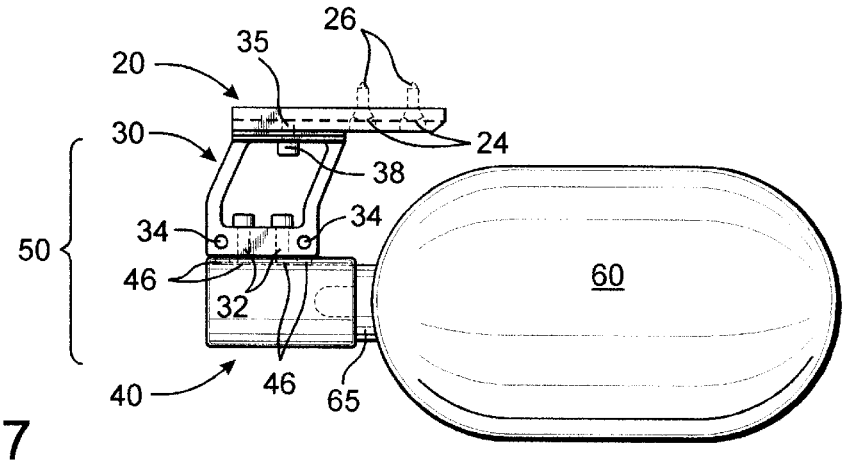
FIG. 7 is side view of the adjustable gas cartridge mount showing the gas cartridge mounted in a center mount orientation so that it is disposed directly underneath the paint gun.
Figure 8:
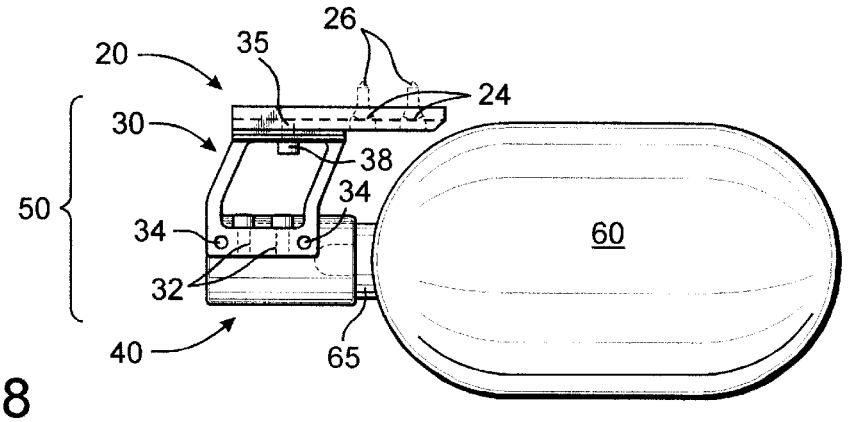
FIG. 8 is a side view of the adjustable gas cartridge mount showing the gas cartridge mounted in a right mount orientation so that the gas cartridge is disposed on the right side of the paint gun.

The adjustable gas cartridge mount 10 includes a primary bracket 20 which is structured to be secured, preferably directly, to the paint gun. The primary bracket 20 is generally elongate, as shown separately in FIG. 1, is structured to be coupled preferably to a handle of the paint gun. As such, the primary bracket 20 preferably includes apertures 24 disposed therein to facilitate removable securement to the paint gun by way of fasteners 26 extending through the apertures 24 in the primary bracket 20 and into the handle of the paint gun as best shown in FIG. 7. Of course, the primary bracket 20 can be integrally formed with the paint gun or can permanently secured thereto.

Figure 2:
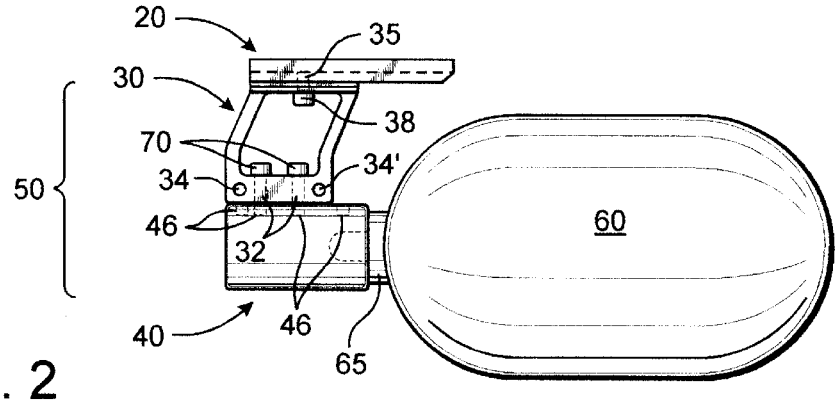
FIG. 2 is a side view of the adjustable gas cartridge mount secured in a forward mount position.
Figure 3:
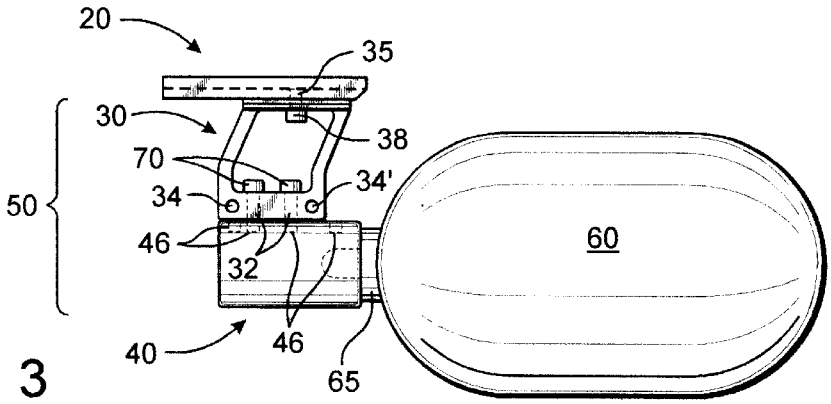
FIG. 3 is a side view of the adjustable gas cartridge mount secured in a rear mount position.
Figure 4:
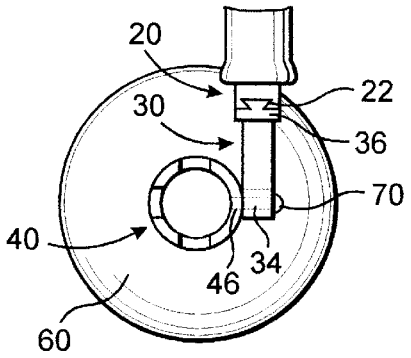
FIG. 4 is a front view of the adjustable gas cartridge mount showing the gas cartridge mounted in a left mount orientation so that it is disposed on the left side of the paint gun.
Figure 6:
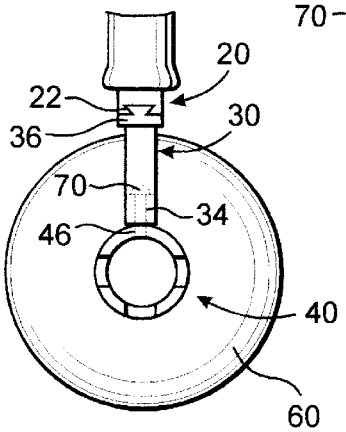
FIG. 6 is a front view of the adjustable gas cartridge mount showing the gas cartridge mounted in a center mount orientation so that it is disposed directly underneath the paint gun.
Figure 5:
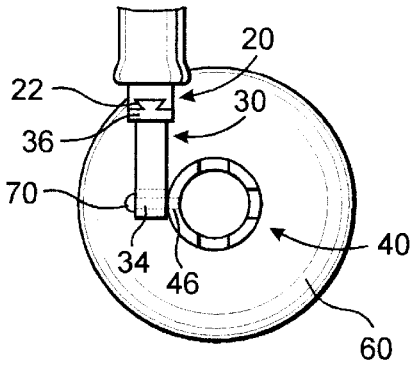
FIG. 5 is a front view of the adjustable gas cartridge mount showing the gas cartridge mounted in a right mount orientation so that it is disposed on the right side of the paint gun.

The adjustable gas cartridge mount 10 includes a cartridge engagement assembly 50 which is disposed generally below the primary bracket 20. More particularly, the cartridge engagement assembly 50 includes an extension segment 30 which extends generally vertically downwards from the primary bracket 20. Furthermore, the cartridge engagement assembly 50 is slidably secured to the primary bracket 20 by way of lateral adjustment means. Specifically, the lateral adjustment means provides for the forward and backwards positioning of the cartridge engagement assembly 50 relative to the paint gun so as to enhance the balance of the paint gun and thereby provide for better maneuverability and handling The lateral adjustment means of the preferred embodiment of the present invention include an elongate track 22 defined within the primary bracket 20, as best shown in FIGS. 4–6. Furthermore, the lateral adjustment means include an elongate track engaging member 36, preferably structured as part of the extension segment 30, and lock means structured to restrict movement of the extension segment 30 relative to the primary bracket 20. In particular, the elongate track engaging member 36 is structured to be slidingly disposed inside the elongate track 22 of the primary bracket 20 so that the position of the extension segment 30, and therefore the gas cartridge 60, can be adjusted into a forward mount position as shown in FIG. 2 or a backwards mount position as shown in FIG. 3, as well as variety of incremental positions therebetween. The lock means of the lateral adjustment means are structured to restrict movement of the extension segment 30 relative to the primary bracket 20, and in the preferred embodiment, the lock means includes at least one aperture 35 disposed in the extension segment so as to allow a fastener 38 to extend through the extension segment 30 and into frictional engagement with the primary bracket 20 so as to restrict movement of the extension segment 30 with respect to the primary bracket 20 and generally secure the extension segment 30 in a select position.

As illustrated in the figures, in the preferred embodiment of the present invention the elongate track engaging member 36 and the elongate track 22 include a generally dove tail configuration to facilitate effective engagement and permit sliding movement during adjustment. Of course a variety of differing configurations, such as a straight bracket or bracket-less engagement can also be implemented. Moreover, the elongate track 22 and track engaging member 36 can be interchangeably positioned on either the primary bracket 20 or the extension segment 30 depending upon the manufacturing desires.

Looking more specifically to the extension segment 30, it preferably includes a generally open configuration with a pair of spaced side supports 33 and a base element 31. In this embodiment, the added weight provided by the extension segment is minimized, while providing a stable configuration that is quite durable and well balanced. Moreover, it is preferred that the side supports include an angled configuration to position the base element in a generally forward position, as it will more often be preferred that the gas cartridge be positioned forward of the handle of the paint gun for increased balance and stability.

The cartridge engagement assembly 50 further includes a cartridge coupling bracket 40. In the preferred embodiment, the cartridge coupling bracket 40 is formed in a generally tubular configuration structured to engage an outlet nozzle region 65 of the gas cartridge 60. The cartridge coupling bracket 40 is structured to be coupled to the gas cartridge 60 and to the extension segment 30, as shown in the figures, in such a manner as to secure the gas cartridge 60 in a preferred generally horizontal orientation relative to the paint gun. This generally horizontal orientation provides for substantially improved handling of the paint gun, especially in tight quarters, and the reduction in the distance between the center of mass of the gas cartridge and the handle of the paint gun permits improved handling and maneuverability of the paint gun. As such, a user is given much more flexibility and can react much more quickly to any given situation requiring the paint gun to be quickly utilized.

In the preferred embodiment, the adjustable gas cartridge mount 10 further includes balance adjustment means oriented towards maintaining the weight and bulk of the gas cartridge 60 in a comfortable and ergonomic manner to suit the user. The balance adjustment means preferably include a series of vertical apertures 32 defined preferably in the base element of the extension segment 30, as well as a series of transverse apertures 34, also extending through the base element 31 of the extension segment 30. Similarly, the cartridge coupling bracket 40 preferably includes coupling apertures 46 defined therein and structured such that one or more fastener elements 70 may selectively extend through the coupling apertures 46 and either the vertical apertures 32 or the transverse apertures 34 of the extension segment 30. Such a variable secure engagement provides the removable coupling of the cartridge coupling bracket 40 in one of several alternative positions as further described below.

For example, in a first position, the cartridge coupling bracket 40, and therefore the gas cartridge 70, are disposed in a generally horizontal orientation at a right side of the paint gun as best shown in FIG. 5. Such an orientation will typically be favored by users who are right-handed due to the particular weight distribution of the gas cartridge 60. Alternatively, however, the cartridge coupling bracket 40 and therefore the gas cartridge 60 can be disposed on the left side of the paint gun as shown in FIG. 4. This position is generally more suitable for those users who are left-handed. Regardless of whether a left-handed or right-handed orientation is chosen, the fasteners 70 will extend through the transverse apertures 34 of the extension segment and into the coupling apertures 46 of the cartridge coupling bracket 40 so as to removably couple the cartridge coupling bracket 40 into position. In yet another alternative position provided by the balance adjustment means, the cartridge coupling bracket 40 is disposed in a generally horizontal orientation and generally aligned at an underside of the paint gun. This alternative position is shown in FIG. 6. Since such a position orients the gas cartridge 60 directly below the paint gun, it provides an even distribution of weight so as to properly balance the gas cartridge 60 along a center line of the paint gun.

Turning to FIGS. 10–13, an alternative embodiment of the balance adjustment means is illustrated. In this embodiment, the balance adjustment means include an adjustable rail assembly 44 structured to be secured, either directly or indirectly, between the cartridge coupling bracket 40' and the extension segment 30 so as to provide for the adjustable coupling of the cartridge coupling bracket 40' relative to the extension segment 30. Specifically, the adjustable rail assembly 44 enables a user to adjustably move the cartridge coupling bracket 40', and therefore the gas cartridge 60 forward and backward relative to the extension segment 30 depending upon the preferences of the user. Moreover, although the adjustable rail assembly 44 can be positioned as in FIG. 12 to provide for a center mounting position of the cartridge directly under the gun, it may be preferable to position the gas cartridge off center, at either a left or right side of the gun. In the alternative embodiment of the balance adjustment means the off center positioning is achieved primarily utilizing a lateral alignment plate 42. The lateral alignment plate 42 is structured to be selectively coupled between the extension segment 30 and the cartridge coupling bracket 40' so as to selectively position the cartridge coupling bracket 40' between a left and a right side of the extension segment 30. It is noted that the lateral alignment plate 42 be secured directly or indirectly to the extension segment, with the adjustable rail assembly 44 in turn being secured to the lateral alignment plate 42, or it can be secured directly or indirectly with the cartridge coupling bracket 40', with the adjustable rail assembly 44 in turn being secured to the extension segment 30. Of course, appropriate fasteners may be provided, including a fastener to lock the adjustable rail assembly 44 in place. Also, the gas cartridge mount 40' may include a round configuration, an alternative squared configuration, or another configuration which may be required to accommodate a gas cartridge 60.

Figure 9:
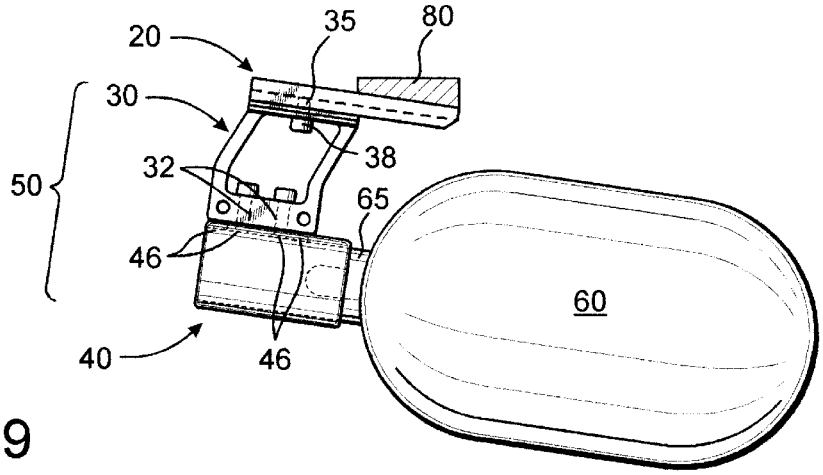
FIG. 9 is a side view showing an alternative embodiment of the adjustable gas cartridge mount wherein a spacer element is disposed between the primary bracket and the paint gun so as to orient the primary bracket, and therefore the cartridge engagement assembly and the gas cartridge, in a desired angular orientation.
Figure 10:
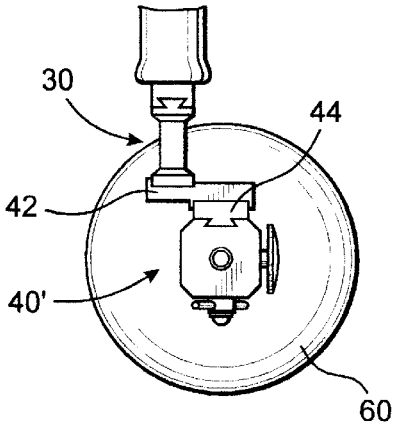
FIG. 10 is a front plan view of an alternative embodiment of the balance adjustment means in a left side mount orientation.
Figure 11:
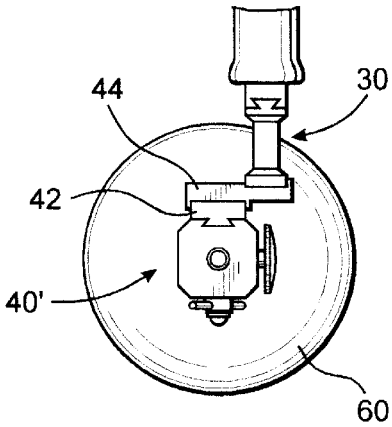
FIG. 11 is a front plan view of an alternative embodiment of the balance adjustment means in a right side mount orientation.
Figure 12:
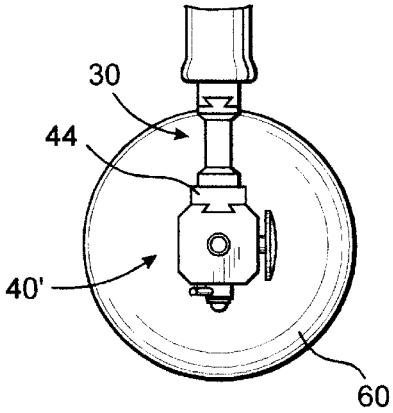
FIG. 12 is a front plan view of an alternative embodiment of the balance adjustment means in a center mount orientation.
Figure 13:
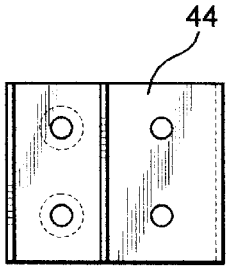
FIG. 13 is an isolated, plan view of the lateral alignment plate utilized with the alternative balance adjustment means of FIG. 10 and FIG. 11.

In another alternative embodiment of the present invention, the adjustable gas cartridge mount 10 includes angling means as shown in FIG. 9. The angling means are structured and disposed to tilt the cartridge coupling bracket 40, and consequently the gas cartridge 60 which is coupled thereto, to a desired angular orientation. Particularly, the angling means include a spacer element 80 which is disposed between the primary bracket 20 and the paint gun so as to orient the primary bracket 20, and therefore the cartridge engagement assembly 50 and the gas cartridge 60 in the desired angular orientation. In the preferred embodiment, the spacer element 80 includes a generally wedge-shaped configuration, although other shapes may be utilized without departing from the present invention. Moreover, this angled orientation is preferably somewhat slight and is provided to accommodate users with particular balance requirements and/or who utilize particular paint gun designs.

Since many modifications, variations, and changes in detail can be made to the described preferred embodiment of the invention, it is intended that all matters in the foregoing description and shown in the accompanying drawings be interpreted as illustrative and within the scope and spirit of this invention, and not in a limiting sense. Thus, the scope of the invention should be determined by the appended claims and their legal equivalents.

Now that the invention has been described,

What is claimed is:

1. An adjustable gas cartridge mount to be used on a paint gun of the type which utilizes a gas cartridge to propel paint pellets from the paint gun, said adjustable gas cartridge mount comprising:

a primary bracket, said primary bracket being structured to be secured to the paint gun, a cartridge engagement assembly, said cartridge engagement assembly including an extension segment, said extension segment being coupled to said primary bracket and extending generally vertically downward therefrom and from the paint gun, said cartridge engagement assembly further including a cartridge coupling bracket, said cartridge coupling bracket being structured to be coupled to the gas cartridge and to said extension segment so as to secure the gas cartridge in a generally horizontal orientation relative to the paint gun such that the gas cartridge does not interfere with a user's grasping and manipulating the paint gun, and balance adjustment means structured to provide for the adjustable coupling of said cartridge coupling bracket to said extension segment such that a weight of the gas cartridge can be maintained on a preferred side relative to the paint gun.

2. An adjustable gas cartridge mount as recited in claim 1 wherein said balance adjustment means include a first position wherein said cartridge coupling bracket and therefore the gas cartridge are disposed in said generally horizontal orientation at generally a left side of the paint gun, and a second position wherein said cartridge coupling bracket and therefore the gas cartridge are disposed in said generally horizontal orientation at generally a right side of the paint gun.

3. An adjustable gas cartridge mount as recited in claim 2 wherein said balance adjustment means further include a third position wherein said cartridge coupling bracket and therefore the gas cartridge are disposed in said generally horizontal orientation at generally an aligned underside of the paint gun.

4. An adjustable gas cartridge mount as recited in claim 3 wherein said balance adjustment means includes at least one vertical aperture defined in said extension segment, at least one transverse aperture extending through said extension segment, at least one coupling aperture defined in said cartridge coupling bracket, and at least one fastener element structured to selectively extend through said coupling aperture and one of said apertures in said extension segment so as to removably couple said cartridge coupling bracket in a select one of said positions.

5. An adjustable gas cartridge mount as recited in claim 1 wherein said primary bracket is structured to be coupled to a handle of the paint gun.

6. An adjustable gas cartridge mount as recited in claim 1 further including lateral adjustment means structured and disposed to provide for adjustable forward and backward positioning of said cartridge coupling bracket relative to the paint gun and thereby enhance a balance between the gas cartridge and the paint gun.

7. An adjustable gas cartridge mount as recited in claim 6 wherein said lateral adjustment means comprise:

an elongate track defined in said primary bracket, and engagement means on said extension segment and structured to be slidingly disposed in said elongate track.

8. An adjustable gas cartridge mount as recited in claim 7 wherein said engagement means includes an elongate track engaging member disposed on said extension segment.

9. An adjustable gas cartridge mount as recited in claim 7 further including lock means structured to restrict movement of said extension segment relative to said primary bracket as provided by said lateral adjustment means.

10. An adjustable gas cartridge mount as recited in claim 1 wherein said cartridge coupling bracket includes a generally tubular configuration structured to engage an outlet nozzle region of the gas cartridge.

11. An adjustable gas cartridge mount as recited in claim 1 further including angling means structured and disposed to tilt said cartridge coupling bracket, and therefore the gas cartridge coupled thereto, to a desired angular orientation.

12. An adjustable gas cartridge mount as recited in claim 11 wherein said angling means includes a spacer element structured to be disposed between said primary bracket and the paint gun so as to orient said primary bracket, and therefore said cartridge engagement assembly and the gas cartridge coupled thereto, in said desired angular orientation.

13. An adjustable gas cartridge mount as recited in claim 12 wherein said spacer element includes a generally wedge like configuration.

14. An adjustable gas cartridge mount as recited in claim 1 wherein said extension segment includes at least one side support and a base element secured thereto, said side support being structured to orient said base element in a generally forward orientation.

15. An adjustable gas cartridge mount as recited in claim 1 further including said balance adjustment means structured to provide for the adjustable coupling of said cartridge coupling bracket to said extension segment, said balance adjustment means including an adjustable rail assembly structured to be secured between said cartridge coupling bracket and said extension segment, said adjustable rail assembly being structured to provide adjustable forward and backward positioning of said cartridge coupling bracket relative to said extension segment.

16. An adjustable gas cartridge mount as recited in claim 15 wherein said balance adjustment means further include a lateral alignment plate structured to be selectively coupled between said extension segment and said adjustable rail assembly so as to selectively position said cartridge coupling bracket between a left and a right side of said extension segment.

17. An adjustable gas cartridge mount as recited in claim 15 wherein said balance adjustment means further include a lateral alignment plate structured to be selectively coupled between said cartridge coupling bracket and said adjustable rail assembly so as to selectively position said cartridge coupling bracket between a left and a right side of said extension segment.

18. An adjustable gas cartridge mount to be used on a paint gun of the type which utilizes a gas cartridge to propel paint pellets from the paint gun, said adjustable gas cartridge mount comprising:

a primary bracket, said primary bracket being structured to be secured to the paint gun, a cartridge engagement assembly, said cartridge engagement assembly including an extension segment, said extension segment being coupled to said primary bracket and extending generally therefrom and from the paint gun, said cartridge engagement assembly further including a cartridge coupling bracket, said cartridge coupling bracket being structured to be coupled to the gas cartridge and to said extension segment so as to secure the gas cartridge relative to the paint gun such that the gas cartridge does not interfere with a user's grasping and manipulating the paint gun, and lateral adjustment means structured and disposed to provide for adjustable forward and backward positioning of said cartridge coupling bracket relative to the paint gun and thereby enhance a balance between the gas cartridge and the paint gun.

19. An adjustable gas cartridge mount to be used on a paint gun of the type which utilizes a gas cartridge to propel paint pellets from the paint gun, said adjustable gas cartridge mount comprising:

a primary bracket, said primary bracket being structured to be secured to the paint gun, a cartridge engagement assembly, said cartridge engagement assembly including an extension segment, said extension segment being coupled to said primary bracket and extending generally therefrom and from the paint gun, said cartridge engagement assembly further including a cartridge coupling bracket, said cartridge coupling bracket being structured to be coupled to the gas cartridge and to said extension segment so as to secure the gas cartridge relative to the paint gun such that the gas cartridge does not interfere with a user's grasping and manipulating the paint gun, and angling means structured and disposed to tilt said cartridge coupling bracket, and therefore the gas cartridge coupled thereto, to a desired angular orientation.

20. An adjustable gas cartridge mount to be used on a paint gun of the type which utilizes a gas cartridge to propel paint pellets from the paint gun, said adjustable gas cartridge mount comprising:

a primary bracket, said primary bracket being structured to be secured to the paint gun, a cartridge engagement assembly, said cartridge engagement assembly including an extension segment, said extension segment being coupled to said primary bracket and extending generally therefrom and from the paint gun, said cartridge engagement assembly further including a cartridge coupling bracket, said cartridge coupling bracket being structured to be coupled to the gas cartridge and to said extension segment so as to secure the gas cartridge relative to the paint gun such that the gas cartridge does not interfere with a user's grasping and manipulating the paint gun, balance adjustment means structured to provide for the adjustable coupling of said cartridge coupling bracket to said extension segment, and said balance adjustment means including an adjustable rail assembly structured to be secured between said cartridge coupling bracket and said extension segment, said adjustable rail assembly being structured to provide adjustable forward and backward positioning of said cartridge coupling bracket relative to said extension segment.

* * * * *